US008857226B2

(12) United States Patent
Hong et al.

(10) Patent No.: US 8,857,226 B2
(45) Date of Patent: Oct. 14, 2014

(54) LAUNDRY TREATMENT MACHINE

(75) Inventors: Sogkie Hong, Seoul (KR); Jongseok Kim, Seoul (KR); Sungmin Kim, Seoul (KR); Daeyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 661 days.

(21) Appl. No.: 13/033,985

(22) Filed: Feb. 24, 2011

(65) Prior Publication Data

US 2011/0232336 A1 Sep. 29, 2011

(30) Foreign Application Priority Data

Feb. 24, 2010 (KR) ..... 10-2010-0016787

(51) Int. Cl.

| | |
|---|---|
| ***D06F 21/00*** | (2006.01) |
| ***D06F 23/00*** | (2006.01) |
| ***D06F 25/00*** | (2006.01) |
| ***D06F 37/04*** | (2006.01) |
| ***D06F 58/06*** | (2006.01) |
| ***D06F 58/04*** | (2006.01) |

(52) U.S. Cl.

CPC ..... *D06F 37/04* (2013.01); *D06F 58/06* (2013.01); *D06F 58/04* (2013.01)

USPC ..... 68/140

(58) Field of Classification Search

None

See application file for complete search history.

(56) References Cited

U.S. PATENT DOCUMENTS

| | | | | |
|---|---|---|---|---|
| 3,143,501 | A | 8/1964 | Worst | 210/380 |
| 3,932,947 | A | 1/1976 | Smoot | 34/242 |
| 4,007,546 | A | 2/1977 | Sauer | 34/133 |

FOREIGN PATENT DOCUMENTS

| | | | |
|---|---|---|---|
| DE | 41 05 686 | A1 | 8/1992 |
| EP | 0 112 138 | A1 | 6/1984 |
| FR | 1275057 | A | 11/1961 |
| FR | 1287505 | A | 3/1962 |
| JP | 59-225100 | A | 12/1984 |
| WO | WO 03/012185 | A2 | 2/2003 |
| WO | WO 2006/120644 | A1 | 11/2006 |

OTHER PUBLICATIONS

European Search Report dated Jun. 25, 2013 issued in Application No. 11 74 7719.

PCT International Search Report and Written Opinion dated Aug. 16, 2011 issued in Application No. PCT/KR2011/001295.

*Primary Examiner* — Jason Ko

(74) *Attorney, Agent, or Firm* — Ked & Associates, LLP

(57) ABSTRACT

A laundry treatment apparatus is provided comprising a cabinet having a prescribed shape; a supporter provided in the cabinet; a drum configured to rotate and provided on the supporter, the supporter supporting a circumferential portion of the drum, a cross section of the drum being a simple closed curve where first distance between a rotational axis of the drum and a first location on an inner surface of the drum is different from second distance between the rotational axis of the drum and a second location on the inner surface of the drum; and a motor to rotate the drum.

9 Claims, 4 Drawing Sheets

LAUNDRY TREATMENT MACHINE

CROSS-REFERENCE TO RELATED APPLICATION(S)

This application claims priority under 35 U.S.C. §119 to Korean Application No. 10-2010-0016787 filed on Feb. 24, 2010, whose entire disclosure is incorporated herein by reference.

BACKGROUND

1. Field

The present disclosure is directed to a laundry treatment apparatus having a larger drum than conventional devices.

2. Background

Laundry treatment apparatuses generally refer to apparatuses for performing treatment, such as washing, drying, or wrinkle removing, on clothing or beddings (hereinafter, simply referred to as "laundry") as used in homes or laundry shops. Laundry treatment apparatuses include washers, dryers and washer/dryer combination. The amount of laundry that may be treated by the laundry treatment apparatuses may be limited based on the size of the drum.

BRIEF DESCRIPTION OF THE DRAWINGS

The embodiments will be described in detail with reference to the following drawings in which like reference numerals refer to like elements wherein.

DETAILED DESCRIPTION OF THE DRAWINGS

Figure 1:
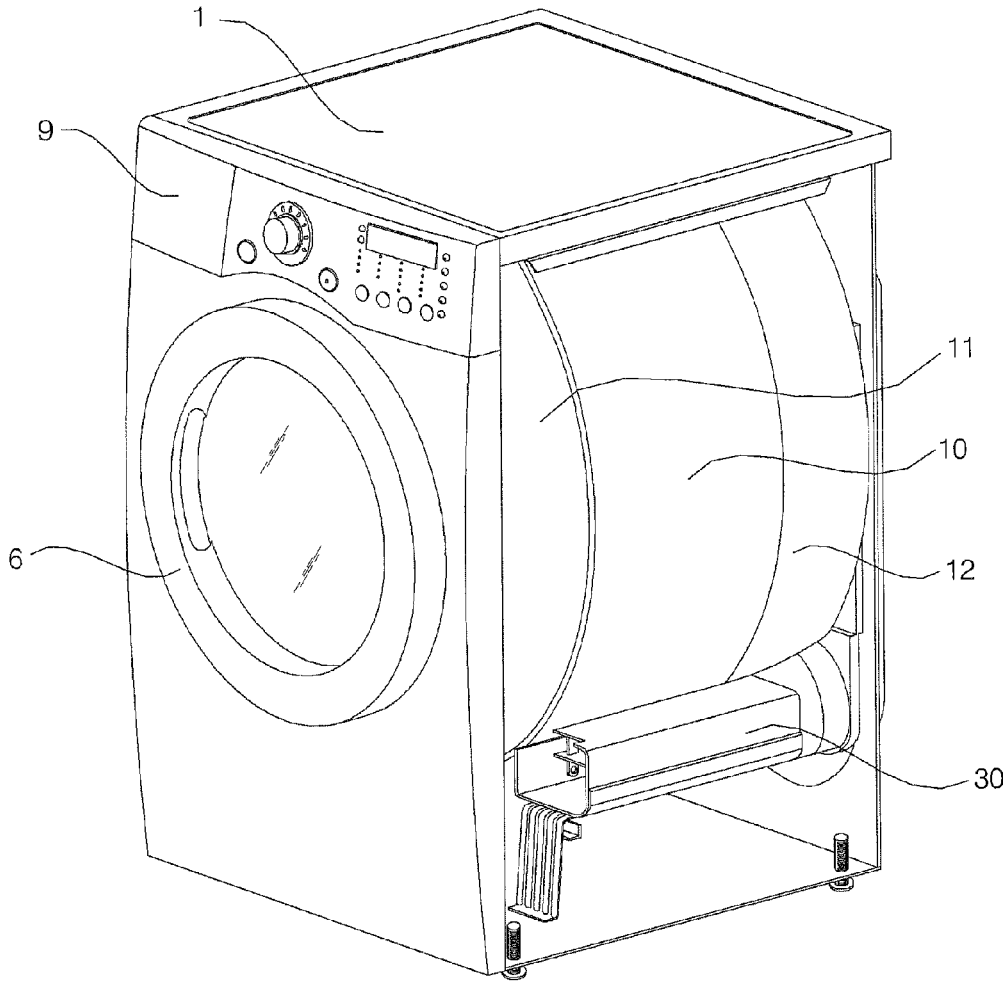
FIG. 1 is a perspective view illustrating a laundry treatment apparatus according to an embodiment of the present disclosure.

FIG. 1 is a perspective view illustrating a laundry treatment apparatus according to an embodiment of the present disclosure. The laundry treatment apparatus includes a cabinet 1, a drum 10, and a heater 30. The cabinet 1 forms the appearance. The drum 10 is rotatably positioned in the cabinet 1. The drum 10 receives laundry. The heater 30 heats air flowing into the drum 10. As shown therein, the cabinet has a prescribed width, height and depth.

The cabinet 1 has an opening for entrance or exit of laundry to/from the drum 10 at a front surface thereof. A door 6 is rotatably connected to the front surface of the cabinet 1 to open and close the opening. The front surface of the cabinet 1 includes a control panel 9 that allows a user to enter operation commands and show operational states to the user.

A front support 11 is provided behind the front surface of the cabinet 1 to support a front end circumferential portion of the drum 10. The front supporter 11 supports the drum 10 so that the drum 10 may rotate.

A rear supporter 12 is provided in front of a rear surface of the cabinet 1 to support a rear end circumferential portion of the drum 10. The rear supporter 12 supports the drum 10 so that the drum 10 may rotate. According to an embodiment, the rear supporter 12 may be opened or include an opening so that air heated by the heater 30 may flow into the drum 10.

Figure 2:
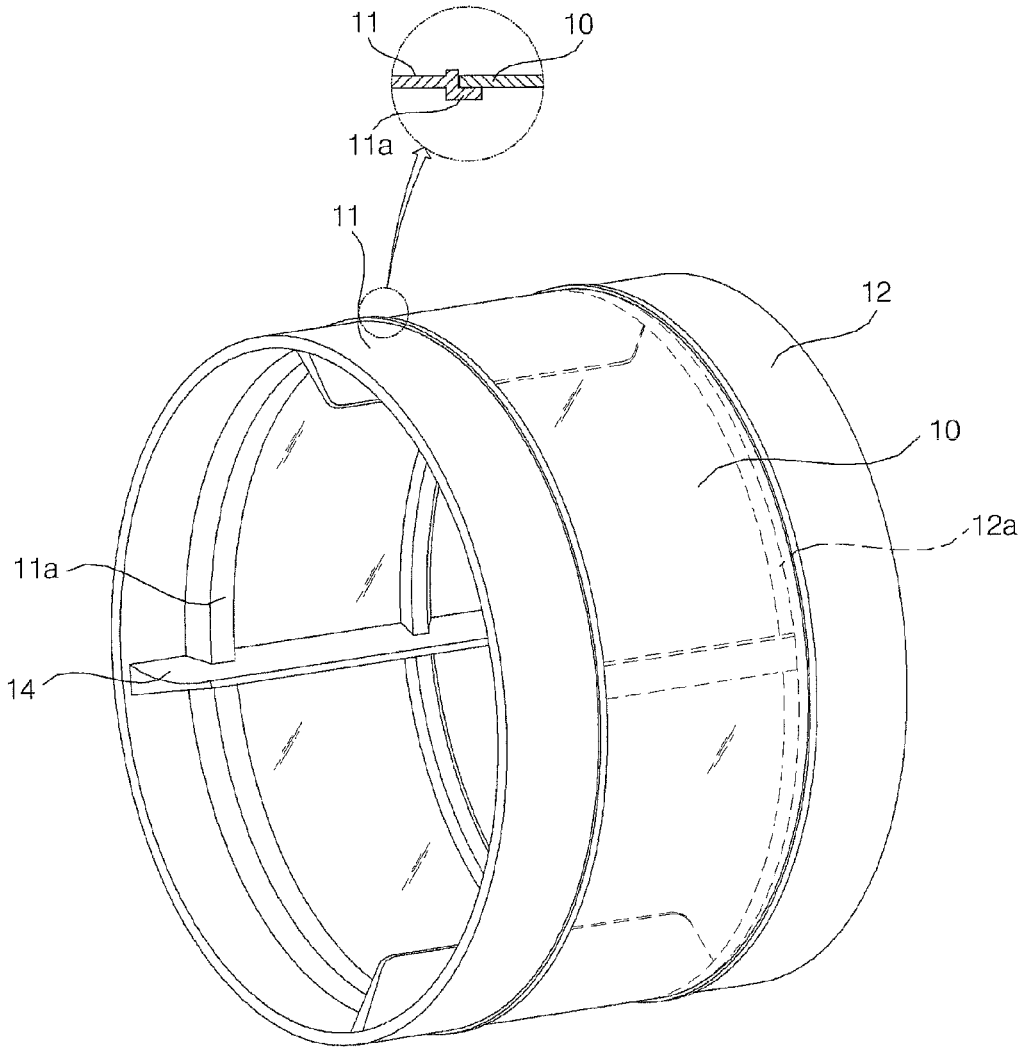
FIG. 2 is a perspective view illustrating a drum of a laundry treatment apparatus according to an embodiment of the present disclosure.

FIG. 2 is a perspective view illustrating a drum of a laundry treatment apparatus according to an embodiment of the present disclosure. The drum 10 is opened in a front and rear direction so that the drum 10 receives laundry and so that air may pass in the drum in the front and rear direction. A cross section of the drum 10 is simple closed curve where first distance between a rotational axis of the drum 10 and a first location on an inner surface of the drum 10 is different from second distance between the rotational axis of the drum 10 and a second location on the inner surface of the drum 10. The cross section of the drum 10 is orthogonal to a rotational axis of the drum 10. The drum 10 includes lifters 14 on an inner surface thereof so that laundry received in the drum 10 may be lifted and dropped. According to an embodiment, the lifters 14 may be slidably connected to the front supporter 11 and the rear supporter 12 to be rotated with the drum 10.

The front and rear end circumferential portions of the drum 10 are supported by the front supporter 11 and the rear supporter 12, respectively. According to an embodiment, front and rear ends of the drum 10 may be slidingly connected to the front supporter 11 and the rear supporter 12, respectively, to allow the drum 10 to be rotated.

The front supporter 11 and the rear supporter 12, respectively, include a front bending portion 11*a* and a rear bending portion 12*a* that are bent inwardly of the drum 10 and brought in contact with circumferential portions of the drum 10 to support the drum 10.

Figure 3:
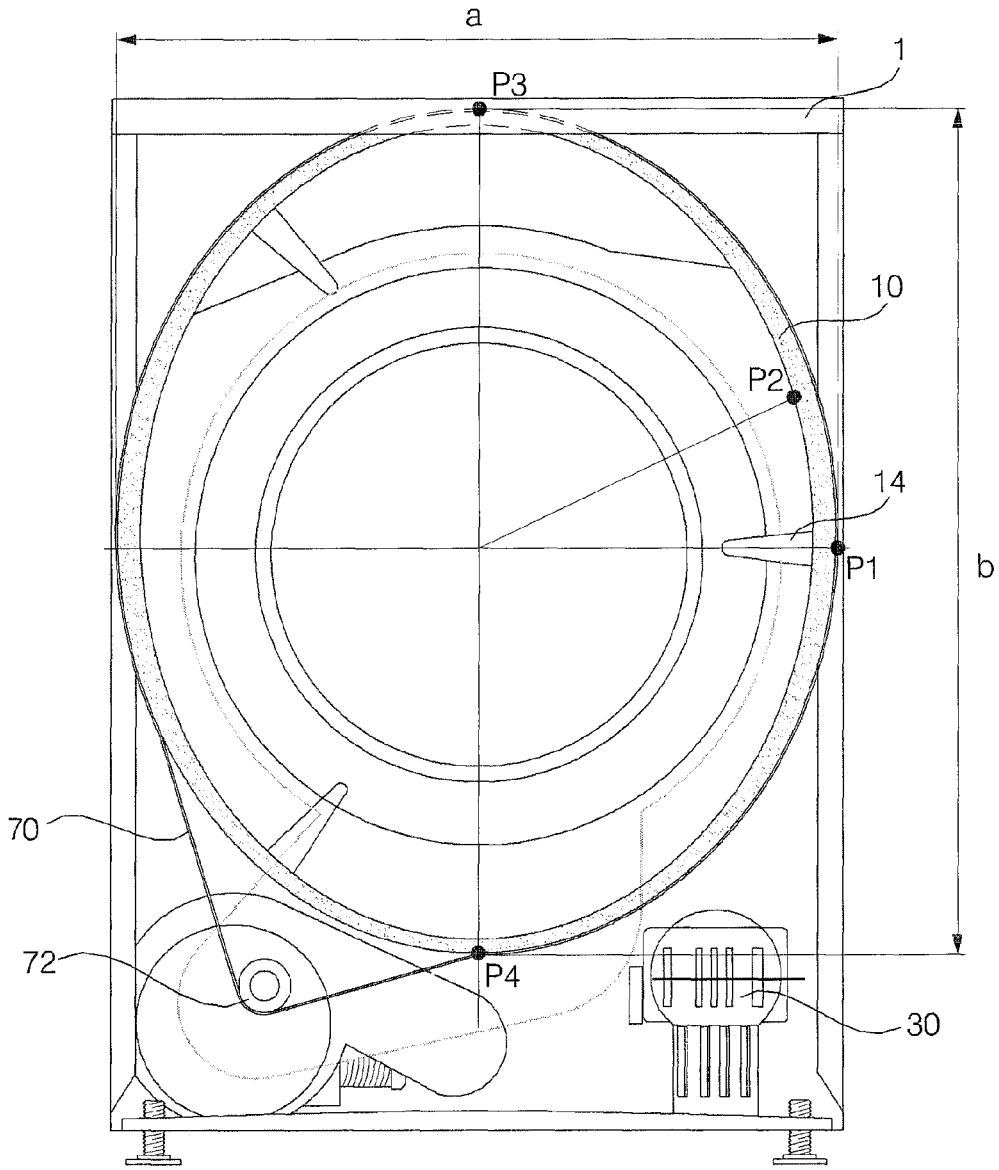
FIG. 3 is a view illustrating a shape of a drum of a laundry treatment apparatus according to an embodiment of the present disclosure.

FIG. 3 is a view illustrating a shape of a drum of a laundry treatment apparatus according to an embodiment of the present disclosure. While the drum 10 is rotated, a cross section of the drum 10 is a simple closed curve in which a distance between a rotational axis of the drum 10 and a point on a circumference of the drum changes along the circumference, e.g., the radius of curvature changes along the circumference of the drum. According to an embodiment, the drum 10 may be formed of a resilient or bendable material, metallic material, or polymer material so that the drum 10 may rotate with the distance uneven.

According to this embodiment, a maximum distance between antipodal points of the simple closed curve (hereinafter, referred to as "maximum distance b") may not be in excess of 1.2 times of a minimum distance between antipodal points of the simple closed curve (hereinafter, referred to as "maximum distance a"). When the maximum distance b is more than 1.2 times of the minimum distance a, it may be difficult for the cross section of the drum 10 to maintain the simple closed curve during rotation.

According to an embodiment, upon rotation of the drum 10, the maximum distance b may be determined depending on a shape of the cabinet 1. According to the present embodiment, the cabinet 1 is configured so that a vertical length is longer than a horizontal length. As a consequence, when the drum 10 is rotated, the maximum distance b is formed in a vertical direction, and the minimum distance a is formed in a horizontal direction. For example, the shape of the simple close curve is a vertical elliptical if the height is larger than the width of the cabinet, whereas the shape of the simple close curve is a horizontal elliptical if the width is larger than the height of the cabinet.

According to another embodiment, at least a portion or some portions of the drum having a simple closed curve shape, e.g., elliptical, may be straight, instead of having a curvature. In other words, the straight portions of the drum have zero curvature, and hence, these portions have an infinite or undefined radius of curvature. According to this embodiment, a straight section or straight portions may not exceed 10% of the whole simple closed curve or the outer circumference of the drum.

According to an embodiment, the drum 10 may be rotated by a driving unit that includes a belt 70 and a motor 72. The belt 70 transfers a rotational force of the motor 72 to the drum 10 to rotate the drum 10 based on contact with an outer circumferential surface of the drum 10 and not to slide on the outer circumferential surface. The belt 70 may be formed of a metal or polymer material that is resilient and easily bendable. According to an embodiment, protrusion and depressions may be formed on the belt 70 and the outer circumferential surface of the drum 10 so that the belt 70 does not slide on the outer circumferential surface of the drum 10.

According to an embodiment, a cross section of a portion of the drum 10 that is supported by the front supporter 11 may be identical to a cross section of a portion of the drum 10 that is supported by the rear supporter 12 so that the drum 10 may be rotated with a cross section of a simple closed curve where a distance between the rotational axis and the simple closed curve is uneven.

Figure 4:
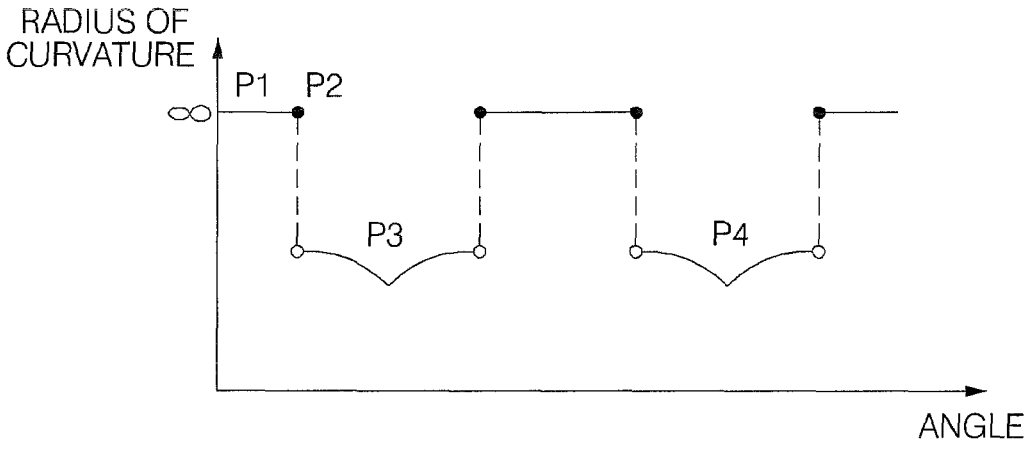
FIG. 4 is a view illustrating a radius of curvature of a drum of a laundry treatment apparatus according to an embodiment of the present disclosure.

FIG. 4 is a view illustrating a radius of curvature of a drum of a laundry treatment apparatus according to another embodiment of the present disclosure. For explaining the shape of drum in this embodiment, Points P1, P2, P3, and P4 of FIG. 3 are used as an example to explain this embodiment. The points P1, P2, P3 and P4 are illustrative points on a circumference of the drum and the FIG. 4 embodiment does not have the shape shown in FIG. 3.

As shown in the radius of curvature graph of FIG. 4, the radius of curvature is infinite at points P1 and P2—that is, points P1 and P2 belong to straight line sections of the simple closed curve. Also, straight line sections occur between points P3 and P4 and between points P4 and P1. As shown in FIG. 4, with respect to point P3, the radius of curvature gradually decreases before point P3 and gradually increases after point P3. This is true for point P4. For example, the radius of curvature becomes the largest at points P3 and P4. As described above, the straight line sections may not exceed 10% of the whole simple closed curve.

According to an embodiment, upon rotation of the drum 10, the radius of curvature becomes infinite at left and right sides of the simple closed curve—for example, straight line sections occur at the left and right sides. The radius of curvature becomes the minimum at upper and lower ends of the simple closed curve.

According to the embodiments of the present disclosure, the drum 10 of the laundry treatment apparatus forms a cross section which is a simple closed curve in which a distance between the simple closed curve and a rotational axis of the drum 10 is uneven when the drum 10 is rotated. As a consequence, more laundry may be received in the drum 10.

As can be appreciated based on the present disclosure, the drum disclosed herein is larger than the drum of a conventional laundry apparatus given that both have the same cabinet dimensions. In the conventional laundry apparatus, the drum is circular whereas, the shape of the drum disclosed herein may be elliptical and may or may not include straight portions. Further, the drum may be any shape so long as the straight portion or portions may not exceed 10% of the shape of the drum generally having a simple closed curve shape.

Further, additional details of the drum and the driving unit may be found in U.S. application Ser. Nos. 12/892,407, 12/892,426 and 12/892,446, all filed on Sep. 28, 2010 at the US Patent and Trademark Office and whose entire disclosure are incorporated herein by reference.

Any reference in this specification to "one embodiment," "an embodiment," "example embodiment," etc., means that a particular feature, structure, or characteristic described in connection with the embodiment is included in at least one embodiment of this disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus, comprising:

a cabinet having a prescribed shape;

a drum provided in the cabinet and configured to rotate, a cross section of the drum being a simple closed curve where a first distance between a rotational axis of the drum and a first location on an inner surface of the drum is different from a second distance between the rotational axis of the drum and a second location on the inner surface of the drum;

a motor;

a belt connected to the motor and extending around an outer surface of the drum to rotate the drum;

a front supporter slidably connected to a front circumferential end portion of the drum to support a front end of the drum;

a rear supporter slidably connected to a rear circumferential end portion of the drum to support a rear end of the drum, wherein the front supporter and the rear supporter maintain the simple closed curve cross section of the drum as the drum rotates; and a plurality of lifters provided on the inner surface of the drum, the plurality of lifters configured to lift and drop laundry items received in the drum, wherein the plurality of lifters is slidably connected to the front supporter and the rear supporter to be rotated together with the drum.

2. The laundry treatment apparatus of claim 1, wherein a maximum distance between antipodal points of the simple closed curve does not exceed 1.2 times of a minimum distance between antipodal points of the simple closed curve when the drum is rotated.

3. The laundry treatment apparatus of claim 1, wherein at least a portion of drum includes at least one straight section.

4. The laundry treatment apparatus of claim 3, wherein the at least one straight section does not exceed 10% of the whole simple closed curve when the drum is rotated.

5. The laundry treatment apparatus of claim 1, wherein a radius of curvature is infinite at left and right sides of the simple closed curve and the radius of curvature becomes a minimum at upper and lower ends of the simple closed curve when the drum is rotated.

6. The laundry treatment apparatus of claim 5, wherein a portion of the simple closed curve where a radius of curvature is infinite does not exceed 10% of the whole simple closed curve when the drum is rotated.

7. The laundry treatment apparatus of claim 1, wherein the drum is rotated so that the simple closed curve has a maximum distance from the rotational axis according to the prescribed shape of the cabinet.

8. The laundry treatment apparatus of claim 7, wherein the drum is rotated so that a vertical length of the drum is more than a horizontal length of the drum.

9. The laundry treatment apparatus of claim 1, wherein the front supporter and the rear supporter each include a bending portion that is bent inwardly with respect to the drum and brought in contact with the front and rear circumferential end portions of the drum, respectively, to support the drum.

* * * * *